US008245420B2

(12) United States Patent
Wilson

(10) Patent No.: US 8,245,420 B2
(45) Date of Patent: Aug. 21, 2012

(54) FLEXIBLE FOOTWEAR

(75) Inventor: Erika S Wilson, West Orange, NJ (US)

(73) Assignee: Patient Pedro LLC, West Orange, NJ (US)

( * ) Notice: Subject to any disclaimer, the term of this patent is extended or adjusted under 35 U.S.C. 154(b) by 651 days.

(21) Appl. No.: 12/024,035

(22) Filed: Jan. 31, 2008

(65) Prior Publication Data

US 2009/0193685 A1 Aug. 6, 2009

(51) Int. Cl.
*A43B 13/00* (2006.01)
*A43B 13/18* (2006.01)

(52) U.S. Cl. ..... 36/102; 36/103; 36/31

(58) Field of Classification Search ..... 36/100, 36/102, 103, 88, 8.3, 9 R, 9 A, 8.1, 31, 7.1 R, 36/7.3

See application file for complete search history.

(56) References Cited

U.S. PATENT DOCUMENTS

| | | | | |
|---|---|---|---|---|
| 2,252,315 | A | 8/1941 | Doree | |
| 2,490,916 | A | 12/1949 | Miller | |
| 2,590,648 | A * | 3/1952 | Pitz | 36/11.5 |
| 3,148,378 | A * | 9/1964 | Tibbitts | 2/239 |
| 4,309,832 | A * | 1/1982 | Hunt | 36/32 R |
| 4,516,336 | A * | 5/1985 | Nissenbaum | 36/7.1 R |
| 6,634,121 | B2 | 10/2003 | Sordi | |
| 7,032,327 | B1 | 4/2006 | Tartaglia | |
| 7,168,190 | B1 * | 1/2007 | Gillespie | 36/102 |
| 7,249,426 | B2 * | 7/2007 | Romano et al. | 36/93 |
| 7,337,558 | B2 | 3/2008 | Terlizzi et al. | |
| D571,084 | S * | 6/2008 | Comeau | D2/925 |
| 7,513,064 | B2 * | 4/2009 | Fuerst | 36/11.5 |
| 7,637,035 | B1 * | 12/2009 | Gillespie | 36/102 |
| D610,785 | S * | 3/2010 | Smith | D2/947 |
| 7,694,435 | B1 * | 4/2010 | Kiser et al. | 36/11.5 |
| 2002/0078591 | A1 | 6/2002 | Morrone | |
| 2003/0070319 | A1 * | 4/2003 | Minden | 36/8.3 |
| 2004/0000070 | A1 | 1/2004 | Wright | |
| 2006/0156576 | A1 | 7/2006 | Sloan | |
| 2007/0204483 | A1 | 9/2007 | Kirsch | |
| 2008/0040949 | A1 * | 2/2008 | Moseley | 36/103 |
| 2010/0018080 | A1 | 1/2010 | Smith | |

* cited by examiner

*Primary Examiner* — Jila M Mohandesi
(74) *Attorney, Agent, or Firm* — Richard S. Roberts, Jr.

(57) ABSTRACT

A shoe includes a shoe upper portion made of flexible material, the upper portion including a foot border, a toe region, front-flex portion, arch region, rear-flex portion, and heel region. A split sole portion is secured to the bottom of the shoe upper portion, the sole portion including a front-sole portion under the toe region of the upper portion, a mid-sole portion under the arch region of the upper portion and a rear-sole portion under the heel region of the upper portion. The front-sole portion folds at the front-flex portion into the mid-sole portion and the rear-sole portion folds at the rear-flex portion into the mid-sole portion.

20 Claims, 3 Drawing Sheets

FLEXIBLE FOOTWEAR

FIELD OF THE INVENTION

The present invention relates generally to footwear, more particular flexible footwear.

BACKGROUND OF THE INVENTION

Women, and some men, have had a love affair with high-heeled shoes for centuries. Women wear high-heels for many events (e.g. work, dates, dancing, etc.). High-heeled shoes, however, have not been kind to the feet of women. After an event, one can often observe a woman struggling to walk after a full day or evening in high-heels. Many women have resorted to carrying large hand bags to accommodate flat shoes to replace high-heels. In response, some manufacturers have created flats that roll-up and/or fold-up. These flat shoes, however, require sizeable hand bags to accommodate them. Many women enjoy wearing high-heels and carrying small handbags. There is a need to develop a flexible shoe that can be compressed and stored in the most compact hand bags. Thus, after a night of dancing in high-heels, a woman with a cute clutch bag does not have to walk to her car barefoot or in pain.

SUMMARY OF THE INVENTION

One embodiment includes a flexible shoe having an upper portion and a sole portion secured to the upper portion. The sole portion consists of three separate sole pieces comprising a front-sole portion, a mid-sole portion, and a rear-sole portion. The upper portion contains a front-flex portion between the front-sole portion and mid-sole portion and a rear-flex portion between the mid-sole portion and the rear-sole portion.

Another embodiment includes a flexible shoe having an upper portion and a sole portion secured to the upper portion. The sole portion consists of three separate sole pieces comprising a front-sole portion, a mid-sole portion, and a rear-sole portion. The upper portion contains a front-flex portion between the front-sole portion and mid-sole portion and a rear-flex portion between the mid-sole portion and the rear-sole portion, wherein the front-sole portion folds at the front-flex portion and said shoe folds into the mid-sole portion and the rear-sole portion folds at the rear-flex portion and said shoe folds into the mid-sole portion.

In certain preferred embodiments of the present invention, a shoe includes an upper portion made of a flexible material, the upper portion including a foot border, a toe region, front-flex portion, arch region, rear-flex portion, and heel region. The upper portion may be made of any flexible, durable material such as leather, suede, nylon, cotton, lycra or spandex. The foot border may also include string, such as a shoe lace to provide support and providing a glove-like fit to the contour of the foot. The foot border may also include elastic. String-like materials can be inserted, glued, hemmed, or attached to the foot border. When a string-like material is used to provide support to a shoe, thin material may be used for the upper portion. The upper portion can completely collapse onto the sole or an insole and then use the string to tighten the foot border to secure the shoe to a foot. Completely collapse means the upper portion is flat without a foot inserted into shoe. The insole of the present invention will be made of a flexible material.

The shoe also desirably includes a sole portion secured to a bottom of an upper portion, the sole portion including a front-sole portion under the toe region of the upper portion, a mid-sole portion under the arch region of the upper portion and a rear-sole portion under the heel region of the upper portion. The sole portion may be made of materials such as leather, suede, rubber, lightweight low-density foam material such as EVA polyethylene blend, rubber, a viso-elastic polymer such as SORBOTHANE and other shock-absorbing materials. The sole portion has equal thickness for the front sole portion, mid sole portion, and rear sole portion.

DETAILED DESCRIPTION OF THE DRAWINGS

The invention generally relates to flexible shoes. Referring to the figures, exemplary embodiments of the invention will now be described. The exemplary embodiments are provided to illustrate the invention and should not be construed as limiting the scope of the invention.

Figure 1:
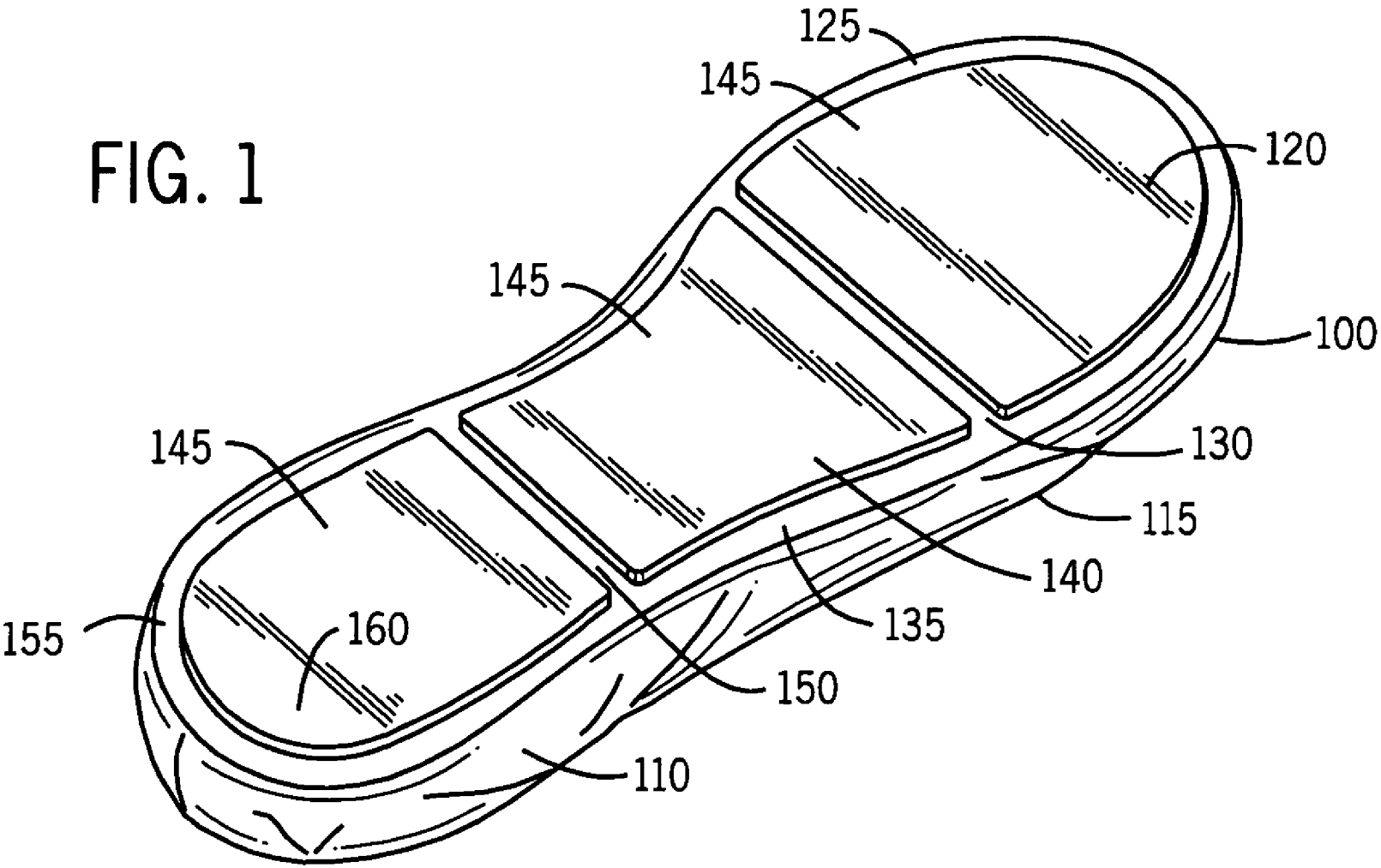
FIG. 1 depicts the shoe in accordance with the invention.
Figure 2:
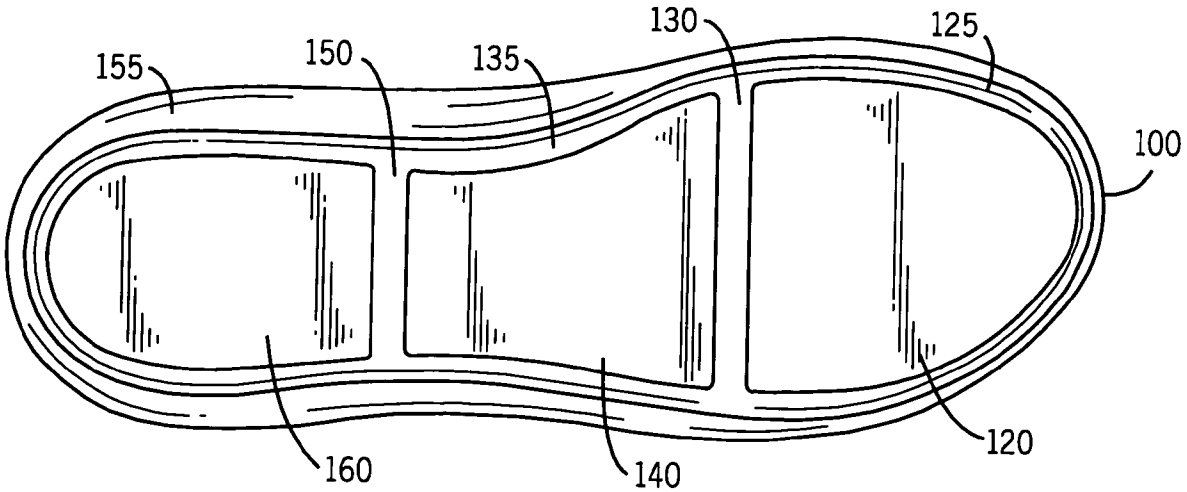
FIG. 2 depicts a bottom view of FIG. 1.

FIG. 1 illustrates a bottom perspective view of shoe 100. Shoe 100 includes an upper portion 110 and a sole portion 145. The upper portion 110 includes a foot border 115 that contours a foot, a toe region 125, a front-flex portion 130, an arch region 135, a rear-flex portion 150, and a heel region 155. As illustrated in the figure, the upper portion is preferably a single and continuous element that extends from the toe region to the heel region, and wherein said single, continuous upper portion is attached to all three of the front-sole, mid-sole and rear-sole portions. As further illustrated in FIG. 1, the front-flex portion 130 of the upper portion 110 is exposed between the front-sole portion 120 and mid-sole portion 140, and the rear-flex portion 150 of the upper portion 110 is exposed between the mid-sole portion 140 and the rear-sole portion 160. The flex portions 130 and 150 allow the shoe to fold into a smaller storable item. A front-sole portion 120 is under the toe region 125 of the upper portion 110, a mid-sole portion 140 is under the arch region 135 of the upper portion 110 and a rear-sole portion 160 is under the heel region 155 of the upper portion 110. FIG. 2 illustrates a bottom view of shoe 100.

Figure 3:
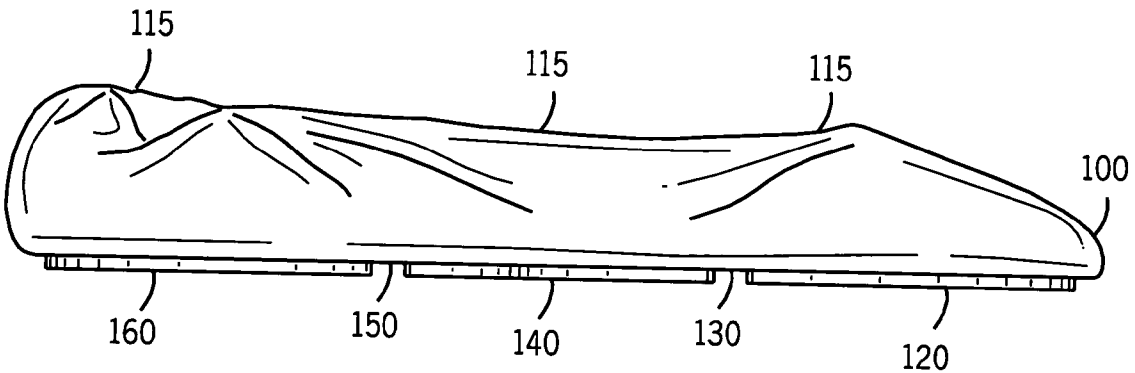
FIG. 3 depicts a side view of FIG. 1.

FIG. 3 illustrates a side view of shoe 100. The sole portion of shoe 100 has equal thickness for the front sole portion 120, mid-sole portion 140, and rear-sole portion 160. Shoe 100 includes a foot border 115. Foot border 115 may include a string (not shown), such as a shoe lace to provide support and tight fit to a foot. Foot border 115 may also include elastic (not shown) to provide support and a tight fit to a foot. Foot border 115 may also contain a combination of elastic and string to secure the shoe 100 to a foot.

Figure 4:
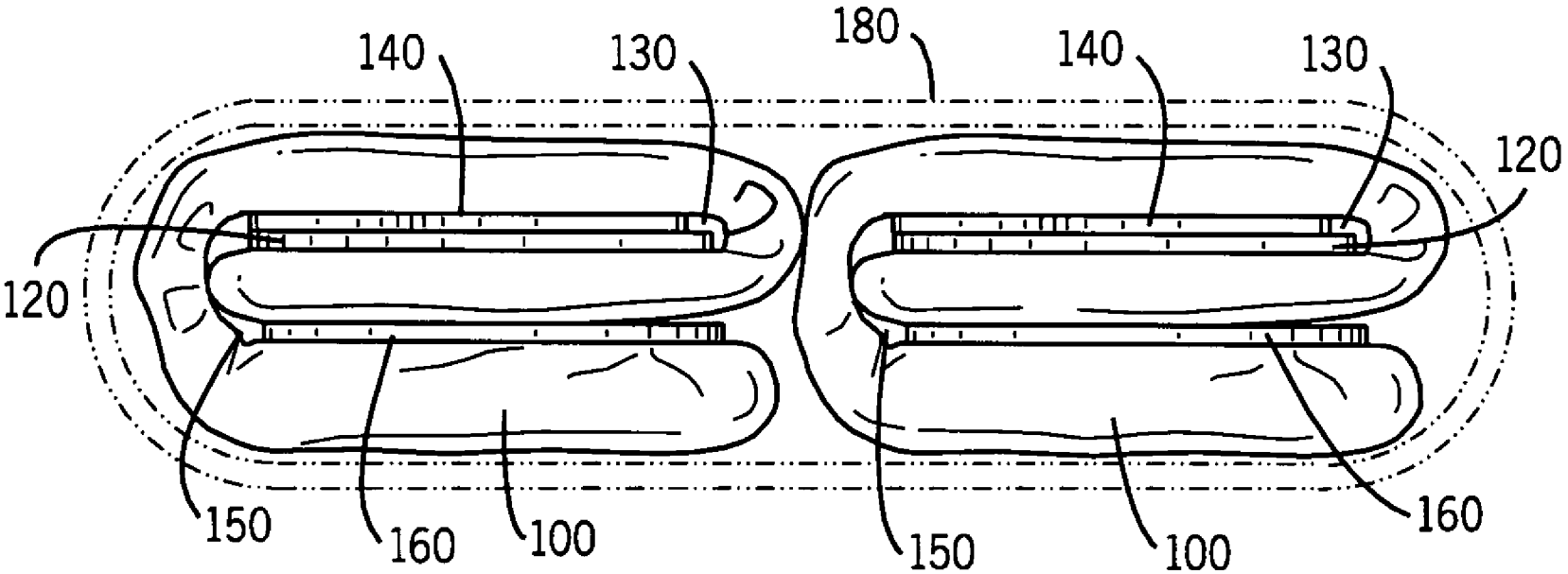
FIG. 4 depicts FIG. 1 folded into a carrying purse.

FIG. 4 illustrates shoe 100 folded into carrying purse 180. As illustrated, the front-sole portion 120 of the shoe 100 folds at the front-flex portion 130 into the mid-sole portion 140 and the rear-sole portion 160 of the shoe 100 folds at the rear-flex portion 150 into the mid-sole portion 140. FIG. 4 more specifically illustrates a preferred embodiment where folding the shoe 100 at the front-flex portion 130 folds the front-sole portion 120 into a plane substantially parallel with a plane containing the mid-sole portion 140 and where folding the shoe 100 at the rear-flex portion 150 folds the rear-sole portion 160 into a plane substantially parallel with a plane containing the mid-sole portion 140. As further illustrated in FIG. 4, front-flex portion 130 and rear-flex portion 150 allow the shoe to maintain a folded condition in the absence of a retaining means. More specifically, FIG. 4 illustrates that when stored in carrying purse 180, the shoe will maintain a folded condition even in the absence of contact with the interior surfaces of the purse or any other retaining means. Folding of the shoe may be performed by first folding the front-sole portion 120 into the mid-sole portion 140 and then optionally folding the rear-sole portion 160 into the mid-sole portion 140, or by first folding the rear-sole portion 160 into the mid-sole portion 140 and then optionally folding the front-sole portion 120 into the mid-sole portion 140. In a preferred embodiment, the shoe 100 is folded at the front-flex portion 130 thereby folding the front-sole portion 120 into a plane substantially parallel with a plane containing the mid-sole portion 140 wherein a surface of the front-sole portion 120 engages in face to face contact with a surface of the mid-sole portion 140, or the shoe 100 is folded at the rear-flex portion 150 thereby folding the rear-sole portion 160 into a plane substantially parallel with a plane containing the mid-sole portion 140, wherein a surface of the rear-sole portion 160 engages in face to face contact with a surface of the mid-sole portion 140. The shoe is capable of folding at the rear-flex portion to thereby fold the rear-sole portion into a plane substantially parallel with a plane containing the mid-sole portion while the front-flex portion is folded and remains folded such that the front-sole sole portion is in a plane substantially parallel with a plane containing the mid-sole portion, and vice versa where the shoe is capable of folding at the front-flex portion to thereby fold the front-sole portion into a plane substantially parallel with a plane containing the mid-sole portion while the rear-flex portion is folded and remains folded such that the rear-sole sole portion is in a plane substantially parallel with a plane containing the mid-sole portion.

The shoe can vary in dimension so as to accommodate various foot shapes and sizes. The shoe is worn by a person by placing a foot in shoe and using a tool, such as a finger. The shoe is also worn by a person by placing a foot in shoe and using a string and/or elastic in the foot border to tighten the shoe around a foot.

In consideration of the above disclosure and statements, the claims appended hereto are intended to be interpreted in a broad sense with the terms used in the claims broadly interpreted in accordance with the meanings as commonly used in the trade.

The invention claimed is:

1. A shoe having an upper portion and a sole portion secured to the upper portion, the sole portion contains three separate soles comprising: a front-sole portion, a mid-sole portion, and a rear-sole portion, wherein the upper portion contains a front-flex portion exposed between the front-sole portion and mid-sole portion, and wherein the upper portion also contains a rear-flex portion exposed between the mid-sole portion and the rear-sole portion, wherein the shoe folds at the front-flex portion thereby folding the front-sole portion into a plane substantially parallel with a plane containing the mid-sole portion wherein the front-sole portion is capable of engaging the mid-sole portion when the shoe is folded and/or the shoe folds at the rear-flex portion thereby folding the rear-sole portion into a plane substantially parallel with a plane containing the mid-sole portion wherein the rear-sole portion is capable of engaging the mid-sole portion when the shoe is folded.

2. The shoe of claim 1, wherein the shoe folds at the front-flex portion thereby folding the front-sole portion into a plane substantially parallel with a plane containing the mid-sole portion.

3. The shoe of claim 1, wherein the shoe folds at the rear-flex portion thereby folding the rear-sole portion into a plane substantially parallel with a plane containing the mid-sole portion.

4. The shoe of claim 1, wherein the shoe folds at the rear-flex portion thereby folding the rear-sole portion into a plane substantially parallel with a plane containing the mid-sole portion while the front-flex portion is folded and remains folded such that the front-sole sole portion is in a plane substantially parallel with a plane containing the mid-sole portion.

5. The shoe of claim 1, wherein the upper portion is flexible.

6. The shoe of claim 1, wherein the upper portion comprises a material selected from the group consisting of leather, suede, nylon, cotton, lycra and spandex.

7. The shoe of claim 1, wherein the sole portion is flexible.

8. The shoe of claim 1, wherein the front-flex portion and rear-flex portion allow the shoe to maintain a folded condition in the absence of a retaining means.

9. The shoe of claim 1 wherein the shoe comprises a single, continuous upper portion, which single, continuous upper portion is attached to all three of the front-sole, mid-sole and rear-sole portions.

10. A shoe having an upper portion comprising a foot border and a sole portion containing three separate soles secured to the upper portion, the sole portion comprising: a front-sole portion, a mid-sole portion, and a rear-sole portion, wherein the upper portion contains a front-flex portion exposed between the front-sole portion and mid-sole portion, and wherein the upper portion also contains a rear-flex portion exposed between the mid-sole portion and the rear-sole portion, wherein the shoe folds at the front-flex portion thereby folding the front-sole portion into a plane substantially parallel with a plane containing the mid-sole portion and the shoe folds at the rear-flex portion thereby folding the rear-sole portion into a plane substantially parallel with a plane containing the mid-sole portion.

11. The shoe of claim 10, wherein the foot border contains a material selected from the group consisting of string, elastic, lace, and mixtures thereof.

12. The shoe of claim 10, wherein the upper portion further comprises a toe region, an arch region and heel region.

13. The shoe of claim 12 wherein the upper portion is continuous and extends from the toe region to the heel region.

14. A foldable shoe having an upper portion and three sole portions secured to the upper portion, the sole portions comprising a front-sole portion, a mid-sole portion, and a rear-sole portion, wherein the upper portion contains a front-flex portion exposed between the front-sole portion and mid-sole portion, and wherein the upper portion also contains a rear-flex portion exposed between the mid-sole portion and the rear-sole portion, wherein the shoe is folded at the front-flex portion thereby folding the front-sole portion into the mid-sole portion and/or the shoe is folded at the rear-flex portion thereby folding the rear-sole portion into the mid-sole portion, wherein the front-flex portion and rear-flex portion allow the shoe to maintain a folded configuration in the absence of a retaining means.

15. The foldable shoe of claim 14, wherein the shoe is folded at the front-flex portion thereby folding the front-sole portion into a plane substantially parallel with a plane containing the mid-sole portion.

16. The foldable shoe of claim 14, wherein the shoe is folded at the rear-flex portion thereby folding the rear-sole portion into a plane substantially parallel with a plane containing the mid-sole portion.

17. The foldable shoe of claim 14, wherein the shoe is folded at the rear-flex portion thereby folding the rear-sole portion into a plane substantially parallel with a plane containing the mid-sole portion while the front-flex portion is folded and remains folded such that the front-sole sole portion is in a plane substantially parallel with a plane containing the mid-sole portion.

18. The foldable shoe of claim 14, wherein the shoe is folded at the front-flex portion thereby folding the front-sole portion into a plane substantially parallel with a plane containing the mid-sole portion, wherein a surface of the front-sole portion engages in face to face contact with a surface of the mid-sole portion.

19. The foldable shoe of claim 14, wherein the shoe is folded at the rear-flex portion thereby folding the rear-sole portion into a plane substantially parallel with a plane containing the mid-sole portion, wherein a surface of the rear-sole portion engages in face to face contact with a surface of the mid-sole portion.

20. The foldable shoe of claim 14, wherein the shoe is stored in a purse.

* * * * *